11/19/85 XR 4,553,338

United States Patent [19]

LeBeau

[11] Patent Number: 4,553,338

[45] Date of Patent: Nov. 19, 1985

[54] ARCHERY BOW ADJUSTABLE SCOPE MOUNT

[76] Inventor: Gary J. LeBeau, 2411 - 90th St., Sturtevant, Wis. 53177

[21] Appl. No.: 648,576

[22] Filed: Sep. 10, 1984

[51] Int. Cl.[4] ..... F41G 1/00

[52] U.S. Cl. ..... 33/265; 33/249; 124/87

[58] Field of Search ..... 33/265, 251, 249, 245; 356/254; 124/87

[56] References Cited

U.S. PATENT DOCUMENTS

| | | | |
|---|---|---|---|
| 3,015,328 | 1/1962 | Ryder | 124/87 |
| 3,266,149 | 8/1966 | Powell | 33/46 |
| 3,419,334 | 12/1968 | Hubbard | 356/254 |
| 3,618,586 | 11/1971 | Current | 33/265 |
| 3,667,444 | 6/1972 | Depatie et al. | 33/265 |
| 4,162,579 | 7/1979 | James | 33/265 |
| 4,294,222 | 10/1981 | Pelsue | 124/87 |
| 4,388,762 | 6/1983 | Debell, Jr. et al. | 33/185 R |

*Primary Examiner*—Willis Little

[57] ABSTRACT

An archery bow adjustable scope mount having a pivot for a mounting and arm on a bow and thereby positioning the scope on the arm in either an operative or a storage position. The scope is adjustable in both the vertical plane, for accommodating various preferences or sizes of archers, and it is adjustable in its focal aspects. Once the adjustments are made, the arm and scope can be swung between the operative and inoperative positions without further adjustments. The scope itself can be focally adjusted by means of a fast lead screw and without the requirement for visually observing the adjustment procedure which can be made by feel or sound.

8 Claims, 7 Drawing Figures

ARCHERY BOW ADJUSTABLE SCOPE MOUNT

This invention relates to an archery bow adjustable scope mount, and, more particularly, it relates to an archery bow adjustable scope mount which is readily and easily positioned to an operative position and to a storage position and which has adjustments for accomodating different archers.

BACKGROUND OF THE INVENTION

The prior art is already aware of the inclusion of a sight scope on a conventional archery bow, such as shown in U.S. Pat. Nos. 3,266,149 and 3,419,334 and 3,667,444, for instance. Those patents show that a scope can be mounted on the archery bow, and, in fact, U.S. Pat. No. 3,667,444 shows that the scope can be mounted in a rearward position to be adjacent the archer's eye. That is, a cantilever type of mounting is employed where one end is attached to the bow and the other end extends rearwardly and holds the scope adjacent the archer's eye. These patents also show various ways of attaching the mounting for the scope to the bow itself, and U.S. Pat. No. 3,419,334 shows a scope construction which is adjustable for its sight.

The present invention differs from the prior art in that it provides for a scope mounting on a bow and wherein the mounting is adjustable to accommodate various archers, both in their sizes and preferences with respect to the positioning of the scope and the adjustment thereof. Further, the present invention differs in that it provides for an adjustable mounting for a cantilever type arm which positions a scope adjacent the archer's eye and which also provides for pivotal movement of the arm to the operating position which has been previously adjustably established and can be regained each time, and which provides for folding or pivoting the said arm to a storage position without forfeiting the aforesaid established operating position.

That is, the present provides for an adjustable mounting for a scope on an archer's bow and which can be arranged for accommodating various positions of the scope and with those positions being selective and reestablished each time the scope is placed into operating positions. Further, the scope can be adjusted to directly and automatically accommodate various distances in focus by the scope, and those adjustments can be accomplished without the need for the archer to read a scale or the like for adjustment, but the adjustment can be made by a sense of touch or hearing in rotations of a dial which clicks in various positions which correspond with various scope focusing distances. In that manner, the archer need not remove his line of vision from a target, but can automatically focus the scope on a distant target.

Still further, the adjustable scope mount of this invention readily accomodates positioning the apparatus in positions for either right hand or left hand archers.

DETAILED DESCRIPTION OF THE PREFERRED EMBODIMENT

Figure 1:
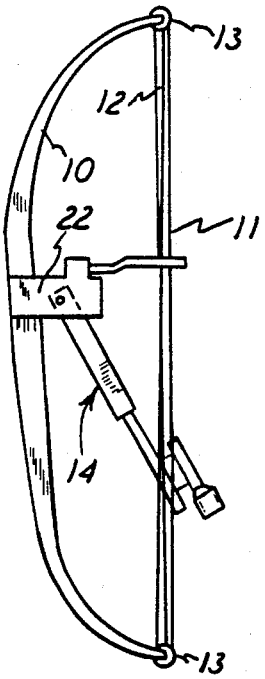
FIG. 1 is a side elevational view of an embodiment of this invention, in the storage position.
Figure 2:
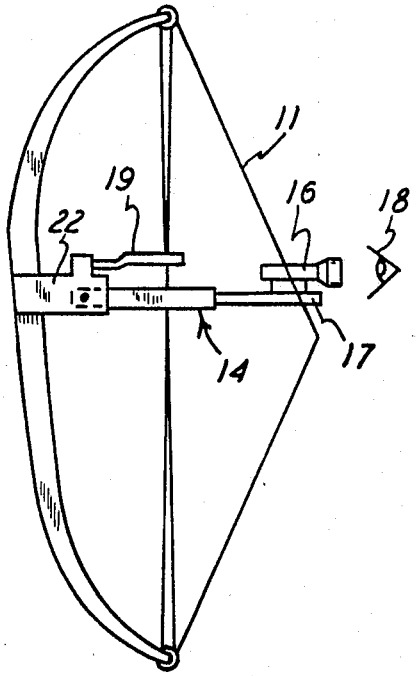
FIG. 2 is a side elevational view of FIG. 1 in the operational position.

FIG. 1 shows the adjustable mount for the scope according to this invention, and a standard bow 10 an string 11 are shown. The usual cable 12 is also show trained over end pulleys 13. FIG. 1 shows the cantileve type arm 14 of this invention, in the storage position and FIG. 2 shows the bow of FIG. 1 but with the arn 14 in the operating or useful position. FIG. 2 therefor shows a scope 16 which is suitably mounted on th extending end 17 of the arm 14 to be positioned adjacen the archer's eye designated 18. Also, the string 11 i shown drawn, and of course the string 11 and the bov 10 are in one plane, and that is the plane in which th arm 14 swings between the FIG. 1 and FIG. 2 positions A cable guard 19 is also shown for the usual purpose o displacing the cables 12 for clearance of the arrow (un shown) when the arrow is released.

Figure 3:
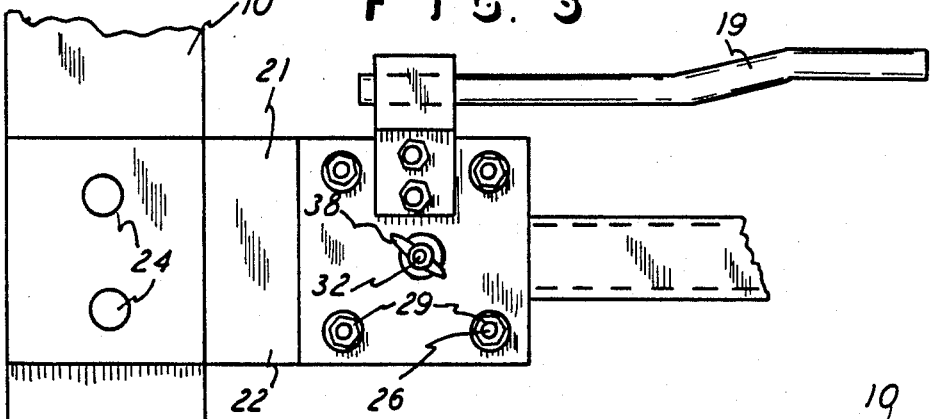
FIG. 3 is an enlarged side elevational view of a portion of the embodiment of FIG. 2, with parts added.
Figure 4:
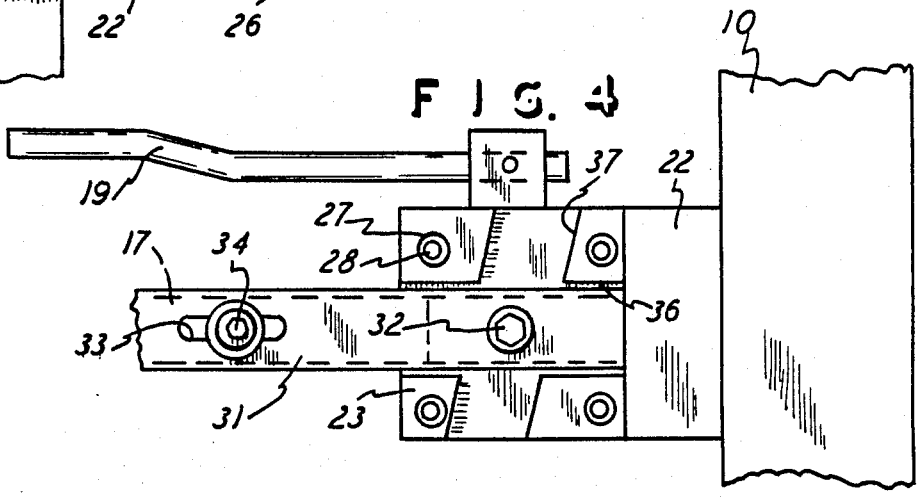
FIG. 4 is a side elevational view of the embodimen of FIG. 2, but from the offset side thereof and with part: added.
Figures 5, 6, 7:
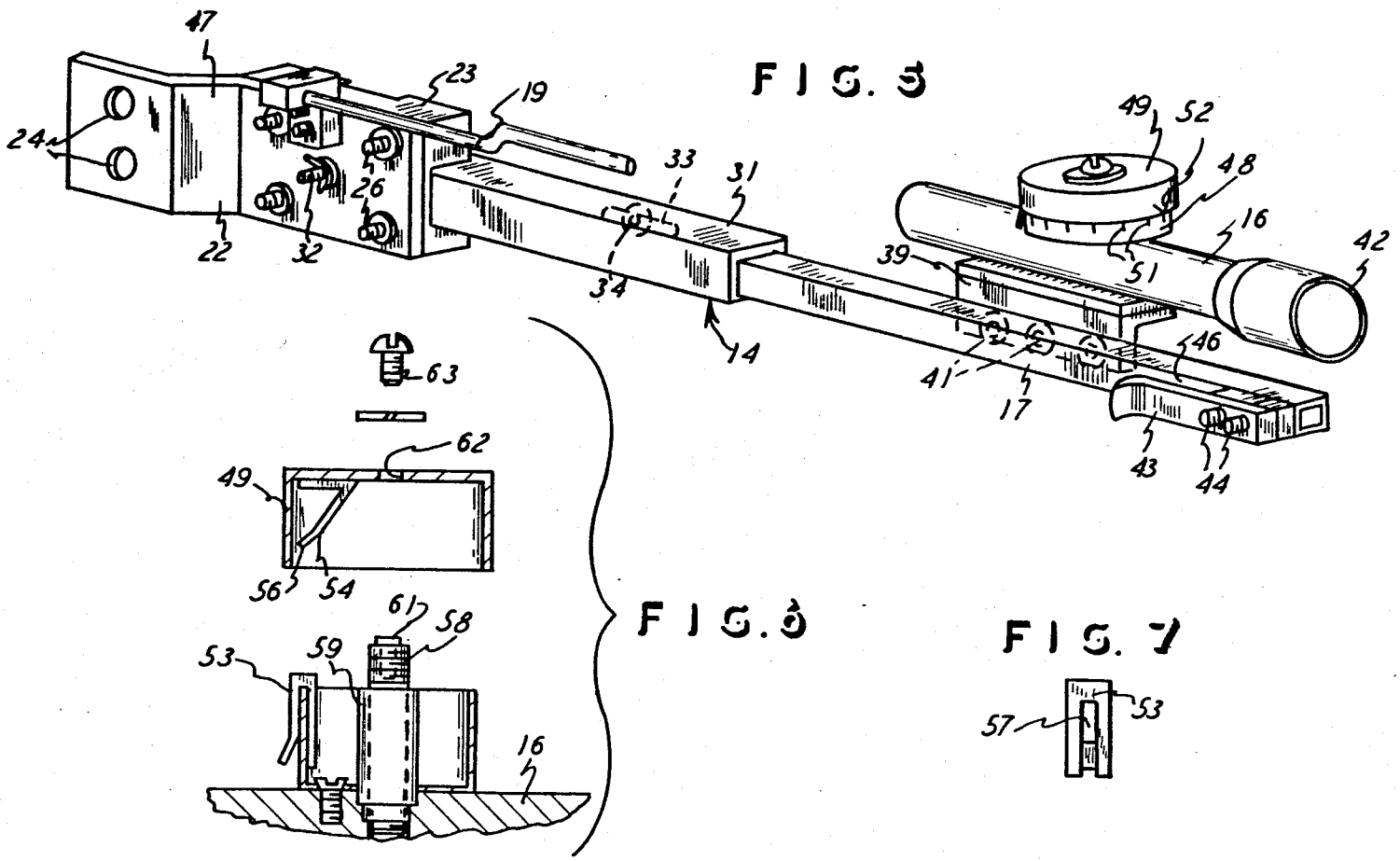
FIG. 5 is an enlarged rear perspective view of a por tion of the embodiment of FIG. 2, with parts added.
FIG. 6 is an enlarged and exploded side elevationa view of a portion of the embodiment of FIG. 5.
FIG. 7 is a front elevational view of a part shown i FIG. 6.

FIGS. 3, 4, and 5 show the detail for mounting th arm 14 on the bow 10, and it will here be seen that ther is an adjustable member 21 which includes a piece 2 and a block 23 bolted to the piece 22. The piece 22 i attached to the bow 10 through the openings 24 in th piece 22, such as by screws or the like. The pieces 2 and 23 are attached together, such as by means of fou bolts 26 extending therethrough, and, as shown in FIG 4, the pieces 22 and 23 have four aligned holes 27 whicl are oversized, relative to the shanks 28 of the four bolt 26, as shown in FIG. 4. In that arrangement, loosenin the nuts 29 on the four bolts 26 will permit the block 2 to be adjustably positioned in a vertical plane relative t the member 22, and thus the extended end 17 of the arn 14 can be positioned adjustably to accommodate differ ent preferences and sizes of archers, including differen lengths of archers ' necks.

The arm 14 includes a tube 31 connected with th member 21 through a pivot bolt 32 extending throug the pieces 22 and 23 and through the tube 31. That i when the nuts 29 are loosened, the arm 14 can pivo up-and-down about the bolt 32, within the limits of th oversized openings 27, as mentioned. Of course upo tightening the bolt 32, the arm 14 is fixed in a substan tially transverse position relative to the bow 10, whe the arm 14 is in the operative position of the drawing except for FIG. 1. FIG. 5 also shows that the arm 1 includes the tubular piece 17 which telescopes with th piece 31, and which is longitudinally adjustable there along through the slot 33 and bolt 34 so that the overa length of the arm 14 can be adjusted within the range c the slot 33 and thereby further accommodate positior ing of the scope 16 in the fore and aft directions relativ to the direction of shooting.

FIG. 4 shows that the piece 23 has a longitudin groove 36 which receives the end of the square tube 3 to serve as a stop and thereby secure and align the tub 31 in the functional position which is transverse to th bow 10, as mentioned. In that regard, it will be seen th the piece 23 has another groove 37 extending substar tially parallel to the bow 10. Upon loosening the bolt 32, the arm 14 can then be swung about the extended and loose bolt 32 to where it aligns with the groove 37 and thus positions the arm 14 in that groove whereupon the bolt 32 can be tightened, such as by means of the wing nut 38, in FIG. 3. In that position, the arm 14 is in the stored position such as shown in FIG. 1.

FIG. 5 shows a scope mounting bracket 39 secured by means of bolts 41 to the arm piece 17 for suitably supporting the scope 16 in the position parallel to the arm 14, as shown. Thus, the eyepiece portion 42 of the scope 16 is adjacent the archer's eye 18, as indicated in FIG. 2. FIG. 5 also shows a string guide 43 attached by means of bolts 44 to the piece 17 to present a groove 46 for receiving the retracted string 11, such as in the FIG. 2 position of the string 11. FIG. 5 shows the arrangement for a left-handed archer, and it will be understood that the member 21 can be mounted on the other side of the bow 10, and, by virtue of the offset portion 47, the reversed mounting will accommodate a right handed archer when the member 17 and the scope mounting 39 are also reversed, all so that the string guide 43 will be to the right side.

With that arrangement, one can position the block 23 in its adjusted position, and the arm 14 can then be swung between the operative position and the storage position, and each time the arm 14 is swung back to the operative position it will be in the precise selected position for that particular archer and no additional adjustments need be made. That is, the degree of pivot of the arm 14 about its pivot bolt 32 will be the same each time, as established by the groove 36, and also the lengthening or shortening of the arm 14, through the slot 33, can be established and set and will be the same all the time after this one setting. Further, the entire mounting remains on the bow 10, even though the mounting is swung between the storage and operative positions mentioned.

FIGS. 5, 6, and 7 show the further adjustable mounting for the scope 16, and here it will be seen and understood that a stationary cylindrical piece 48 is suitably fastened to the scope 16, and a rotatable cylindrical piece 49 extends over the piece 48 and cooperates therewith. The piece 48 may have indicator markings 51 therearound, and the piece 49 may have a pointer marking 52 thereon, as shown in FIG. 5. In final analysis, rotation of the cap or piece 49 will move its indicator 52 around the piece 48 and thereby adjust the distance focal indication of the scope 16. U.S. Pat. No. 3,419,334 shows the manner in which that scope is adjusted, and the present invention could also utilize that type of adjustment with its unique adjustment members 48 and 49, as being described herein.

Each of the markings 51 on the piece 48 is further identified by a clip 53 attached to the piece 48 as shown in FIG. 6 where one clip 53 is shown. There would of course be a plurality of clips 53 which can be adjustably positioned around the member 48 and which can cooperate with a pointer 54 or the like affixed to the piece 49, as indicated in FIG. 6. That is, the pointer 54 is attached to the piece 49 and rotates therewith, and its tip 56 contacts the various clips 53 in sequence, and the clips 53 can have an opening 57 therein for receiving the pointer 56. With that arrangement, rotation of the cap 49 will position the pointer 56 in the clip opening 57 and thereby establish that particular adjustment for the scope 16 since the cap 49 is affixed to a threaded member 58 extending down into the scope 16 to adjust the focal aspects of the scope 16, such as in the manner previously and conventionally mentioned. There is a threaded sleeve 59 affixed with the member 48 and the scope 16 for threadingly receiving the rotatable stud 58 whose upper end 61 can be a square end fitting into the square opening 62 in the cap 49. A screw 63 can be embedded in the stud 58 for securing the members together.

Accordingly, rotation of the cap 49 will generate an audible click, or a sensitivity to the finger touch, to indicate the turning of the cap 49 on the piece 48 and thus indicate the focal adjustment of the scope 16, without actually visually observing the rotation of the cap 49. Each click or graduation could indicate a five yard focal distance, and the screw is a fast lead screw with, for instance, 24 threads per inch.

The thread is actually a six-pitch thread with four leads. So the screw travels 0.166 inches for each revolution, and is therefore faster than a conventional screw.

The novelty is in the scope 16 being a short eye-relief type positionable adjacent the eye. Thus, there is good visibility in poor light conditions. The employment of a string channel gives superior accuracy in arrow placement, and from considerable distances. Because of the design of this mount which employs a channel for the bow string and employs a telescope that is responsive to any lateral or vertical movement of the archer's hand in positioning just prior to arrow release, this construction will, even in the hands of only a reasonably skilled archer using a hand-held mechanical releasing device, deliver accuracy equal to or surpassing any existing sighting device or combination thereof, and do it under a wider range of lighting conditions.

What is claimed is:

1. In an archery bow adjustable scope mount having a bow and an archery string attached thereto and having an arm with one end supported from said bow and a scope mounted on the other end of said arm, the improvement comprising an adjustable member adjustably mounted on said bow for adjustable movement in the plane of said bow and there being fastening means for securing said adjustable member in adjusted positions on said bow, said arm being pivotally mounted on said adjustable member for swinging movement in the plane of said bow for selectively positioning said arm substantially parallel to said bow, for storage, and also transverse to said bow where said scope is available for sighting use adjacent the archer's eye when the archer has drawn said string in normal use, said arm and said adjustable member having a stop operative therebetween for locating the pivoted position of said arm on said adjustable member when said arm is pivoted to the transverse position, said adjustable member being adjustably mounted on said bow for selectively positioning said scope along said plane and thereby accommodate different size archers.

2. The archery bow adjustable scope mount as claimed in claim 1, including said arm being in two pieces adjustable along said arm for extending the length of said arm.

3. The archery bow adjustable scope mount as claimed in claim 1, wherein said adjustable member is reversible in its mounting on said bow to be arranged to be mounted on said bow for either right hand or left hand archers.

4. In an archery bow adjustable scope mount having a bow and an archery string attached thereto and having an arm with one end mounted on said bow and a scope mounted on the other end of said arm, the improvement comprising said arm being pivotally mounted on said bow for swinging movement in the plane of said bow and said string for selectively positioning said arm both substantially parallel to said bow, for storage, and also transverse to said bow where said scope is available for sighting use adjacent the archer's eye when the archer has drawn said string in normal use, an adjustable member mounted on said bow for adjustable movement in said plane and there being fastening means for securing said member in adjusted positions, said arm and said adjustable member having a stop operative therebetween for locating the position of said arm on said bow when said arm is pivoted to the transverse position, said adjustable member being adjustably mounted on said bow for selectively positioning said scope in the direction along said string and thereby accommodate different size archers, and an adjustment member on said scope for adjusting the sight through said scope relative to the position of said arm.

5. The archery bow adjustable scope mount as claimed in claim 4, wherein said adjustment member is a threaded member and includes a stationary piece and a rotatable piece, said stationary piece having stops spaced therealong and said rotatable piece having a pointer for individually engaging said stops in the adjustment of said scope.

6. The archery bow adjustable scope mount as claimed in claim 5, wherein said stops are movably mounted on said stationary piece, for selectively arranging the adjustment of said scope.

7. The archery bow adjustable scope mount as claimed in claim 6, including markings on both said pieces corresponding to the focal distance of said scope in accordance with the rotation of said rotatable piece.

8. In an archery bow adjustable scope mount having a bow and an archery string attached thereto and having an arm with one end mounted on said bow and a scope mounted on the other end of said arm, the improvement comprising said arm being pivotally mounted on said bow for swinging movement in the plane of said bow and said string for selectively positioning said arm both substantially parallel to said bow for storage, and also transverse to said bow where said scope is available for sighting use adjacent the archer's eye when the archer has drawn said string in normal use, said arm and said bow having a stop operative therebetween for locating the position of said arm on said bow when said arm is pivoted to the transverse position, and an adjustment member on said scope for adjusting the sight through said scope relative to the position of said arm.

* * * * *